US008514163B2

(12) United States Patent
Pak et al.

(10) Patent No.: US 8,514,163 B2
(45) Date of Patent: Aug. 20, 2013

(54) DISPLAY APPARATUS INCLUDING A GATE DRIVING PART HAVING A TRANSFERRING STAGE AND AN OUTPUT STAGE AND METHOD FOR DRIVING THE SAME

(75) Inventors: Sang-Jin Pak, Yongin-si (KR); Chang-Hyeon Shin, Suwon-si (KR); Joo-Seok Yeom, Suwon-si (KR); Myung-Woo Lee, Seoul (KR); Hyung-Guel Kim, Yongin-si (KR); Kee-Han Uh, Yongin-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 956 days.

(21) Appl. No.: 11/866,087

(22) Filed: Oct. 2, 2007

(65) Prior Publication Data

US 2008/0079676 A1 Apr. 3, 2008

(30) Foreign Application Priority Data

Oct. 2, 2006 (KR) ..... 10-2006-0097133
Nov. 28, 2006 (KR) ..... 10-2006-0118335

(51) Int. Cl.
*G09G 3/36* (2006.01)

(52) U.S. Cl.
USPC ..... 345/100; 345/99

(58) Field of Classification Search
USPC ..... 345/98–100
See application file for complete search history.

(56) References Cited

U.S. PATENT DOCUMENTS 6,667,730 B1 * 12/2003 Taguchi et al. ..... 345/99
2005/0184946 A1 * 8/2005 Pyoun et al. ..... 345/94
2006/0125763 A1 * 6/2006 Akai et al. ..... 345/98
2006/0238482 A1 * 10/2006 Jang et al. ..... 345/100

FOREIGN PATENT DOCUMENTS

KR 10-2006-0111160 10/2006

OTHER PUBLICATIONS

English Abstract for Publication No. 10-2006-0111160, Oct. 2006.

* cited by examiner

*Primary Examiner* — Chanh Nguyen
*Assistant Examiner* — Long D Pham
(74) *Attorney, Agent, or Firm* — F. Chau & Associates, LLC

(57) ABSTRACT

In a display apparatus and a method for driving the display apparatus, the display apparatus includes a display panel and a gate driving part. The display panel has a gate line, and a gate driving part has a plurality of stages and a plurality of signal lines. At least one of the stages includes a transferring stage sequentially driving the stage, and an output stage partially driving the gate line, in response to a signal outputted from the transferring stage and a driving area selection signal. Accordingly, the display apparatus is partially driven, so that current consumption may be decreased, the display apparatus may be more safely driven, and a position, a size and the number of a non-display area may be more easily controlled.

10 Claims, 11 Drawing Sheets

DISPLAY APPARATUS INCLUDING A GATE DRIVING PART HAVING A TRANSFERRING STAGE AND AN OUTPUT STAGE AND METHOD FOR DRIVING THE SAME

CROSS-REFERENCE TO RELATED APPLICATIONS

This application claims priority under 35 U.S.C. §119 to Korean Patent Application No. 2006-97133, filed on Oct. 2, 2006, and Korean Patent Application No. 2006-118335, filed on Nov. 28, 2006 in the Korean Intellectual Property Office (KIPO), the contents of which are herein incorporated by reference in their entireties.

BACKGROUND OF THE INVENTION

1. Technical Field

The present disclosure relates to a display apparatus and a method for driving the display apparatus. More particularly, the present disclosure relates to the display apparatus capable of partially displaying an image and the method for driving the display apparatus.

2. Discussion of Related Art

Generally, a liquid crystal display (LCD) apparatus, which is a type of flat panel display apparatus, includes a display panel a gate driving part and a data driving part. The display panel includes a plurality of gate lines and a plurality of data lines crossing the gate lines. The gate driving part is electrically connected to the gate lines to apply a gate signal, and the data driving part applies a data signal to the data lines synchronized with the gate signal.

Conventionally, the display panel is electrically connected to a printed circuit board (PCB) or an insulating film on which a chip having the gate and data driving parts is mounted, or the display panel is directly connected to the chip that is mounted on the display panel. An amorphous silicon gate structure is also sometimes employed. More specifically, the gate driving part in which a thin-film transistor (TFT) is not needed to have rapid response, is directly formed in a peripheral area of the display panel, through a display cell array forming process forming an amorphous silicon TFT in the display panel.

In the amorphous silicon gate structure, the gate driving part includes a shift register having a plurality of stages that are dependently connected with each other and signal lines applied to the plurality of stages. Each stage of the shift register is electrically connected to the gate line in a one to one relationship, to output the gate signal. Accordingly, since the stages are dependently connected with each other, display information is continuously refreshed over all screens even though the screen includes a non-display area. This means that power consumption is increased. The amorphous silicon gate structure developed up to now may not easily be formed to obtain a position and a size of the desired non-display area. Furthermore, reliability or movement characteristics of the amorphous silicon gate structure may be poor, so as to adversely affect the image display.

SUMMARY OF THE INVENTION

Exemplary embodiments of the present invention provide a display apparatus including a gate driving circuit having good reliability and movement characteristics.

Exemplary embodiments of the present invention also provide a method for driving the display apparatus.

In a display apparatus according to an exemplary embodiment of the present invention, a display apparatus includes a display panel and a gate driving part. The display panel has a gate line, and the gate driving part has a plurality of stages and a plurality of signal lines.

At least one of the stages includes a transferring stage sequentially driving the stages, and an output stage partially driving the gate line, in response to a signal outputted from the transferring stage and a driving area selection signal. A first period of the driving area selection signal includes a high-level period, and a second period of the driving area selection signal includes a low-level period.

The transferring stage may include a first transferring pull-up driving control part generating a first control signal, a second transferring pull-up driving control part generating a second control signal, and a transferring pull-up driving part generating an output signal in response to the first and second control signals. The output signal of the transferring stage may include a carry signal operating a next transferring stage, a first reset signal resetting a previous transferring stage and a previous output stage, and a delivery signal operating a current output stage.

The output stage may include a first output pull-up driving control part generating a third control signal a second output pull-up driving control part generating a fourth control signal, and an output pull-up driving part generating an output signal in response to the third and fourth control signals. The output signal of the output stage includes a gate signal. The output signal of the output stage further includes a second reset signal.

The first output pull-up driving control part may include a control terminal receiving a transferring pull-up signal, an input terminal receiving the driving area selection signal, and an output terminal outputting the third control signal.

The driving area selection signal has a first phase in an area corresponding to a display period, and has a second phase different from the first phase in an area corresponding to a non-display period. The driving area selection signal has a high level in the area corresponding to the display period, and has a low level in the area corresponding to the non-display period.

The output stage may include a first output pull-up driving control part generating a third control signal, a second output pull-up driving control part generating a fourth control signal, and an output pull-up driving part generating a gate signal in response to the third and fourth control signals. The driving area selection signal has a high level in an area corresponding to a display period, and has a low level in an area corresponding to a non-display period. The first output pull-up driving control part may include a control terminal receiving an output signal of a transferring pull-up driving part, an input terminal receiving the driving area selection signal, and an output terminal outputting a third control signal.

In a method for driving a display apparatus according to an exemplary embodiment of the present invention, the method includes refreshing display information in all display areas, with respect to all frames, changing a display mode to a partial screen display mode, refreshing all the display information in all pixels of the display area and a non-display area, at a first frame of the partial screen display mode, and refreshing the display information in the pixels of the display area at frames following a second frame of the partial screen display mode.

The method further includes refreshing all the display information in the pixels of the display area and the non-display area, when the number of frames after the partial screen display mode reaches a predetermined number of frames.

The refreshed display information in the pixels of the display area has a reversed polarity relative to that of the display information in the pixels of the previous frame. The refreshed display information in the pixels of the non-display area has the polarity reversed relative to that of the refreshed display information in the pixels of the previous frame.

According to an exemplary embodiment of the present invention, the display apparatus is only partially driven, so that current consumption may be decreased.

In addition, the display apparatus may be more safely operated, and a position, a size and the number of the non-display area may be easily controlled.

BRIEF DESCRIPTION OF THE DRAWINGS

Exemplary embodiments of the present invention will be understood in more detail from the following descriptions taken in conjunction with the accompanying drawings, in which.

DESCRIPTION OF EXEMPLARY EMBODIMENTS

The invention is described more fully hereinafter with reference to the accompanying drawings, in which exemplary embodiments of the present invention are shown. This invention may, however, be embodied in many different forms and should not be construed as limited to the exemplary embodiments set forth herein. Rather, these exemplary embodiments are provided so that this disclosure will be thorough and complete, and will fully convey the scope of the invention to those of ordinary skill in the art.

Figure 1:
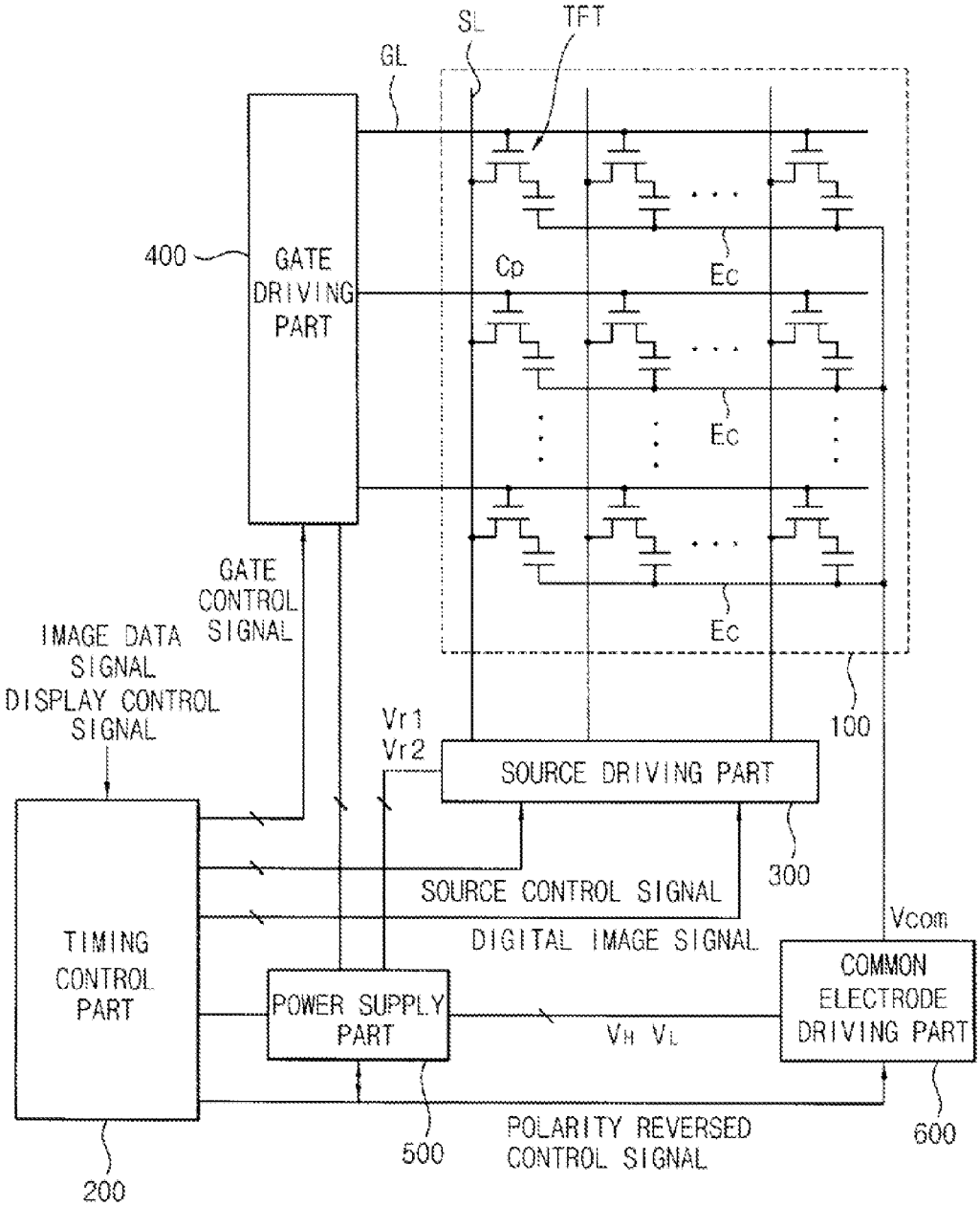
FIG. 1 is a block diagram illustrating a display apparatus according to an exemplary embodiment of the present invention.

FIG. 1 is a block diagram illustrating a display apparatus according to an exemplary embodiment of the present invention.

Referring to FIG. 1, the display apparatus includes a liquid crystal display panel 100, a timing control part 200, a source driving part 300, a gate driving part 400, a power supply part 500 and a common electrode driving part 600. The timing control part 200 receives an image data signal and a display control signal that are externally supplied, to output a gate control signal to the gate driving part 400, and to output a source control signal and a digital image signal to the source driving part 300. In this case, the gate control signal includes a driving area selection signal Vpa illustrated in FIGS. 2 and 4. A waveform of the driving area selection signal Vpa will be described hereinbelow. A conventional technique may be applied in the connection of the liquid crystal display panel 100, the source driving part 300, the power supply part 500 and the common electrode driving part 600. Two or more of the timing control part 200, the source driving part 300, the gate driving part 400, the power supply part 500, and the common electrode driving part 600 may be combined with one another to form one chip.

Figure 2:
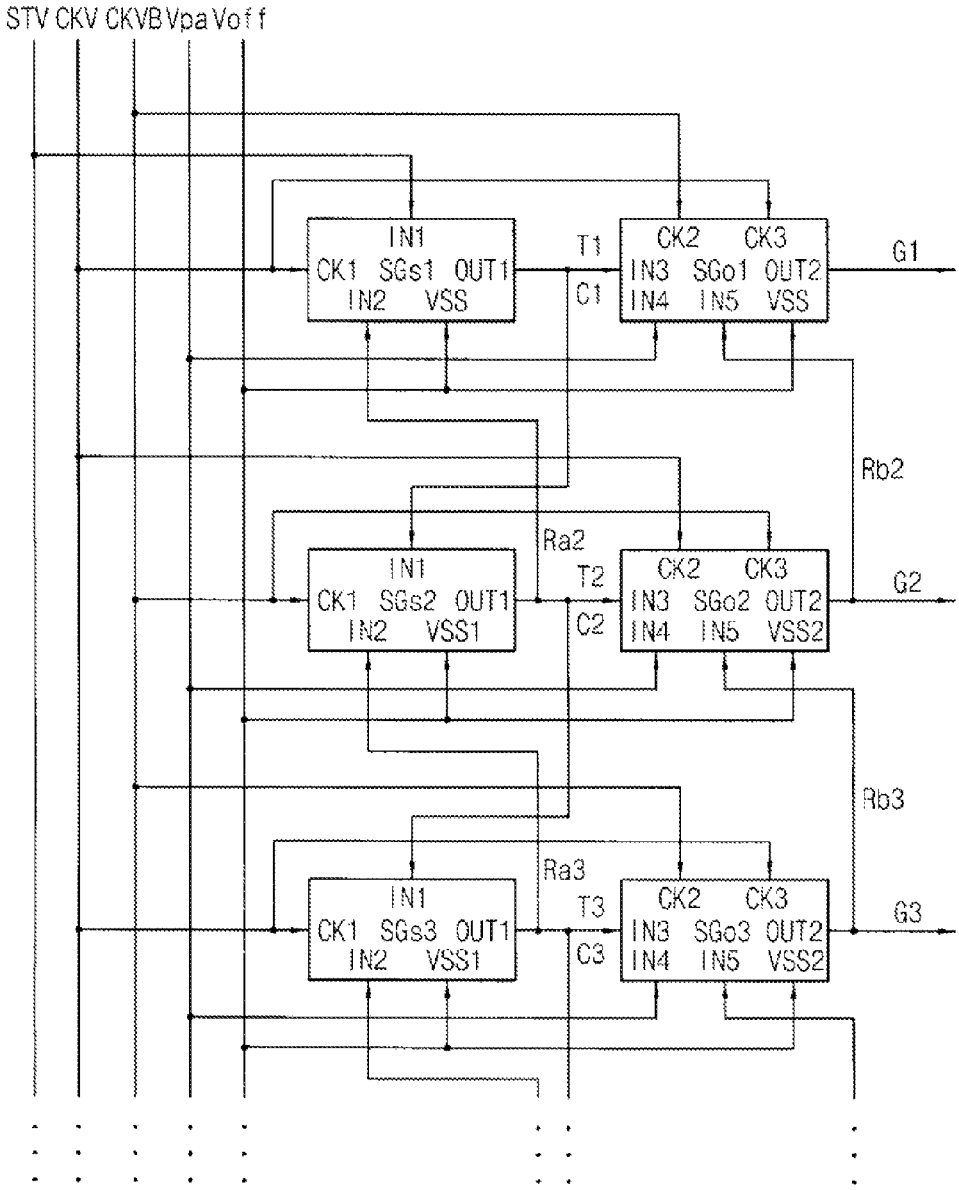
FIG. 2 is a block diagram illustrating a gate driving part according to an exemplary embodiment of the display apparatus in FIG. 1.

FIG. 2 is a block diagram illustrating a gate driving part 400 according to an exemplary embodiment of the display apparatus in FIG. 1.

Referring to FIG. 2, a gate driving part 400 includes a shift register having a plurality of transferring stages SGsi, a plurality of output stages SGoi, and a plurality of signal lines STY, CKV, CKVB, Vpa, Voff, Ci, Ti, Rai, Rbi and Gi that are inputted to or outputted from the transferring stages SGsi and the output stages SGoi.

The transferring stage SGsi includes a first clock terminal CK1, a first input terminal IN1, a second input terminal IN2, a first output terminal OUT1, and a power source terminal VSS. The output stage SGoi includes a second clock terminal CK2, a third clock terminal CK3, a third input terminal IN3, a fourth input terminal IN4, a fifth input terminal IN5, a second output terminal OUT2, and the power source terminal VSS.

Odd-numbered stages of the driving stage are connected as follows.

In an odd-numbered transferring stage SGs2*k*−1, the first clock terminal CK1 is electrically connected to the clock signal CKV line. The first input terminal IN1 is electrically connected to the first output terminal OUT1 of a previous transferring stage SGs2*k*−2 through a carry signal C2*k*−2 line. The second input terminal IN2 is electrically connected to the first output terminal OUT1 of a next transferring stage SGs2*k* through a first reset signal Ra2*k* line. The first output terminal OUT1 is electrically connected to the second input terminal IN2 of the previous transferring stage SGs2*k*−2, the first input terminal IN1 of the next transferring stage SGs2*k* and a third input terminal IN3 of a current output stage SGo2*km*, through the first reset signal Ra2*k*−1 line, the carry signal C2*k*−1 line and a delivery signal T2*k*−1 line. The power source terminal VSS is electrically connected to the gate off voltage Voff line.

In an odd-numbered output stage SGo2*k*−1, the second clock terminal CK2 is electrically connected to the reversed clock signal CKVB line. The third clock terminal CK3 is electrically connected to the clock signal CKV line. The third input terminal IN3 is electrically connected to the first output terminal OUT1 of the transferring stage SGs2*k*−1 through the delivery signal T2*k*−1 line. The fourth input terminal IN4 is electrically connected to the driving area selection signal Vpa line. The fifth input terminal IN5 is electrically connected to the second output terminal OUT2 of the next output stage SGo2*k* through the second reset signal Rb2*k* line. The second output terminal OUT2 is electrically connected to the gate signal G2*k*−1 line, and is electrically connected to the fifth input terminal IN5 of the previous output stage SGo2*k*−2 through the second reset signal Rb2*k*−1. The power source terminal VSS is electrically connected to the gate off voltage Voff line.

In a first transferring stage SGs1 that does not have a previous stage, the first input terminal IN1 is electrically connected to the vertical start signal STV line, and the first output terminal OUT1 is electrically connected to the first input terminal IN1 of the next transferring stage SGs2. In a first output stage SGo1 that does not have a previous stage, the first output terminal OUT1 is electrically connected to the gate signal G1 line.

Even-numbered stages of the driving stage are connected as follows.

In an even-numbered transferring stage SGs2*k*, the first clock terminal CK1 is electrically connected to the reversed clock signal CKVB line. Connections of the first input terminal IN1, the second input terminal IN2, the first output terminal OUT1 and the power source terminal VSS are substantially the same as in the odd-numbered transferring stage SGs2*k*−1.

In an even-numbered output stage SGo2*k*, the second clock terminal CK2 is electrically connected to the clock signal CKV, and the third clock terminal CK3 is electrically connected to the reversed clock signal CKVB. Connections of the third input terminal IN3, the fourth input terminal IN4, the fifth input terminal IN5, the second output terminal OUT2 and the power source terminal VSS are substantially the same as in the odd-numbered output stage SGo2*k*−1.

In the exemplary embodiment, the shift register is driven by the clock signal CKV and the reversed clock signal CKVB. The exemplary embodiment of the present invention, however, may be applicable to a conventional shift register stage that may be divided into the transferring stage and the output stage.

Figure 3:
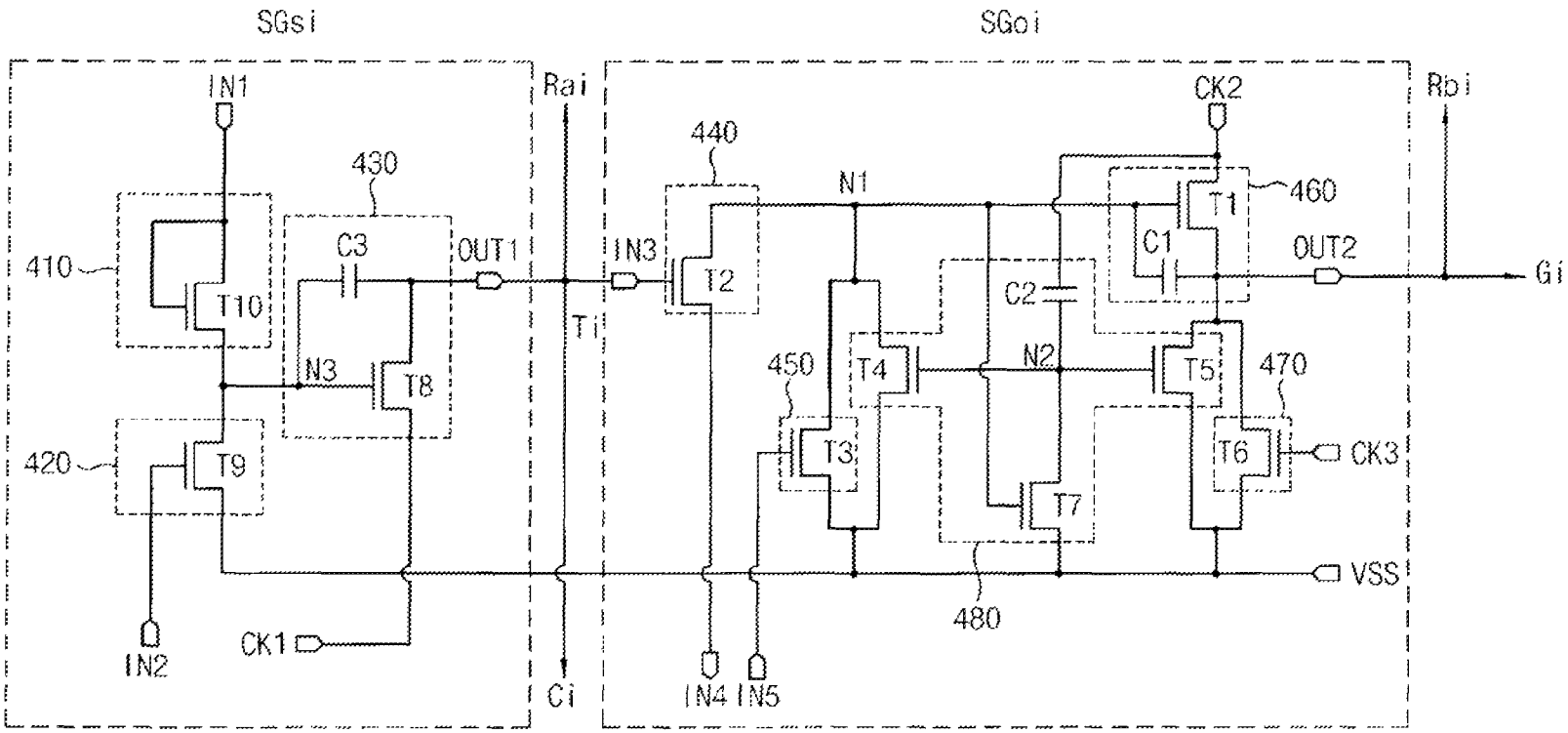
FIG. 3 is a circuit diagram illustrating one of the stages shown in FIG. 2.

FIG. 3 is a circuit diagram illustrating one of the stages shown in FIG. 2.

Referring to FIG. 3, each of the stages includes the transferring stage SGsi and the output stage SGoi.

The transferring stage SGsi is divided into a first transferring pull-up driving control part 410, a second transferring pull-up driving control part 420 and a third transferring pull-up driving part 430.

The first transferring pull-up driving control part 410 includes a tenth thin-film transistor (TFT) T10. A drain electrode and a gate electrode of the tenth TFT T10 are electrically connected to the first input terminal IN1 in common, and a source electrode of the tenth TFT T10 is electrically connected to a third node N3. The first transferring pull-up driving control part 410 receives the vertical start signal STV or a carry signal Ci−1 of the previous transferring stage SGsi−1 through the first input terminal IN1, to provide a first control signal having a high level to a control terminal of the transferring pull-up driving part 430.

The second transferring pull-up driving part 420 includes a ninth TFT T9. A drain electrode and a source electrode of the ninth TFT T9 are respectively connected to the third node N3 and the power source terminal VSS, and a gate electrode of the ninth TFT T9 is electrically connected to the second input terminal IN2. The second transferring pull-up driving control part 420 receives a first reset signal Rai+1 of the next transferring stage SGsi+1 from the second input terminal IN2, to provide a second control signal having a low level to the control terminal of the transferring pull-up driving part 430.

The transferring pull-up driving part 430 includes an eighth TFT T8 and a third capacitor C3. A drain electrode and a source electrode of the eighth TFT T8 are respectively connected to the first clock terminal CK1 and the first output terminal OUT1, a gate electrode of the eighth TFT T8 is electrically connected to the third node N3, and the third capacitor C3 is formed between the gate and source electrodes of the eighth TFT T8. The third capacitor C3 may be a parasitic capacitor between the gate and source electrodes of the eighth TFT T8 or, alternatively, may be a separate additional capacitor. The transferring pull-up driving part 430 selectively outputs the clock signal CKV or the reversed clock signal CKVB inputted to the first clock terminal CK1 to the first output terminal OUT1 according to the first and second control signals.

The output stage SGoi is divided into a first output pull-up driving control part 440, a second output pull-up driving control part 450, an output pull-up driving part 460, an output pull-down driving part 470, and an output maintenance part 480.

The first output pull-up driving control part 440 includes a second TFT T2. A drain electrode and a source electrode of the second TFT T2 are respectively connected to the fourth input terminal IN4 and a first node N1, and a gate electrode is electrically connected to the third input terminal IN3. The first output pull-up driving control part 440 receives the driving area selection signal Vpa and the delivery signal Ti from the third input terminal IN3 and the fourth input terminal IN4, to provide the third control signal having a high level to the control terminal of the output pull-up driving part 460.

The second output pull-up driving control part 450 includes a third TFT T3. A drain electrode and a source electrode of the third TFT T3 are respectively connected to the first node N1 and the power source terminal VSS, and a gate electrode of the third TFT T3 is electrically connected to the fourth input terminal IN4. The second output pull-up driving control part 450 receives the second reset signal Rbi+1 of the next output stage SGoi+1 from the fifth input terminal IN5, to provide a fourth control signal having a low level to the control terminal of the output pull-up driving part 460.

The output pull-up driving part 460 includes a first TFT T1 and a first capacitor C1. A drain electrode and a source electrode of the first TFT T1 are respectively connected to the first clock terminal CK1 and the second output terminal OUT2, and a gate electrode of the first TFT T1 is electrically connected to the first node N1. The first capacitor C1 is formed between the gate and source electrodes of the first TFT T1. The first capacitor C1 may be a parasitic capacitor between the gate and source electrodes of the first TFT T1 or, alternatively, may be a separate additional capacitor. The output pull-up driving part 460 selectively outputs the clock signal CKV or the reversed clock signal CKVB inputted to the first clock terminal CK1 to the second output terminal OUT2 according to the third and fourth control signals.

The output pull-down driving part 470 includes a sixth TFT T6. A drain electrode and a source electrode of the sixth TFT T6 are respectively connected to the second output terminal OUT2 and the power source terminal VSS, and a gate electrode of the sixth TFT T6 is electrically connected to the third clock terminal CK3. The output pull-down driving part 470 selectively outputs the gate off voltage Voff inputted to the power source terminal VSS to the second output terminal OUT2 according to the reversed clock signal CKVB or the clock signal CKV inputted to the third clock terminal CK3.

The output maintenance part 480 includes a fourth TFT T4, a seventh TFT T7, a fifth TFT T5 and a second capacitor C2. A drain electrode and a source electrode of the fourth TFT T4 are respectively connected to the first node N1 and the power source terminal VSS, and a gate electrode of the fourth TFT T4 is electrically connected to the second node N2. A drain electrode and a source electrode of the seventh TFT T7 are respectively connected to the second node N2 and the power source terminal VSS, and a gate electrode of the seventh TFT T7 is electrically connected to the first node N1. A drain electrode and a source electrode of the fifth TFT T5 are respectively connected to the second output terminal OUT2 and the power source terminal VSS, and a gate electrode of the fifth TFT T5 is electrically connected to the second node N2. The second capacitor C2 is formed between the second clock terminal CK2 and the second node N2. The output maintenance part 480 maintains the gate off voltage Voff safely, until the gate line that has been turned on and turned off is turned on in the next frame.

The stage circuit according to an exemplary embodiment of the present invention is designed by adding three TFTs and one capacitor to the conventional stage circuit having seven TFTs and two capacitors. The present invention, however, may be applicable to conventional stage circuits that may be divided into the transferring stage and the output stage.

The gate driving part 400 according to an exemplary embodiment of the present invention may be formed in a peripheral area of a display substrate when a display cell array and a circuit are formed. Alternatively, the gate driving part 400 may be combined with the display substrate through an additional integrated circuit. In addition, the gate driving part 400 may be formed by adding a process to the process used in forming a display cell array.

Size, thickness, length and so on of the TFT, the capacitor, the signal line and so on forming the gate driving part of the exemplary embodiment of the present invention, may be safely optimized to operate the gate driving part. An array in the substrate may be optimized to minimize signal delay, interference and so on. For example, the eighth TFT T8 may be designed to be smaller than the first, fifth and sixth TFTs T1, T5 and T6, because the carry signal Ci, the delivery signal Ti, and the first reset signal Rai just transfer signals between stages. In addition, one or all of the output pull-down driving part 470 and the output maintenance part 480 may be omitted.

Figure 4:
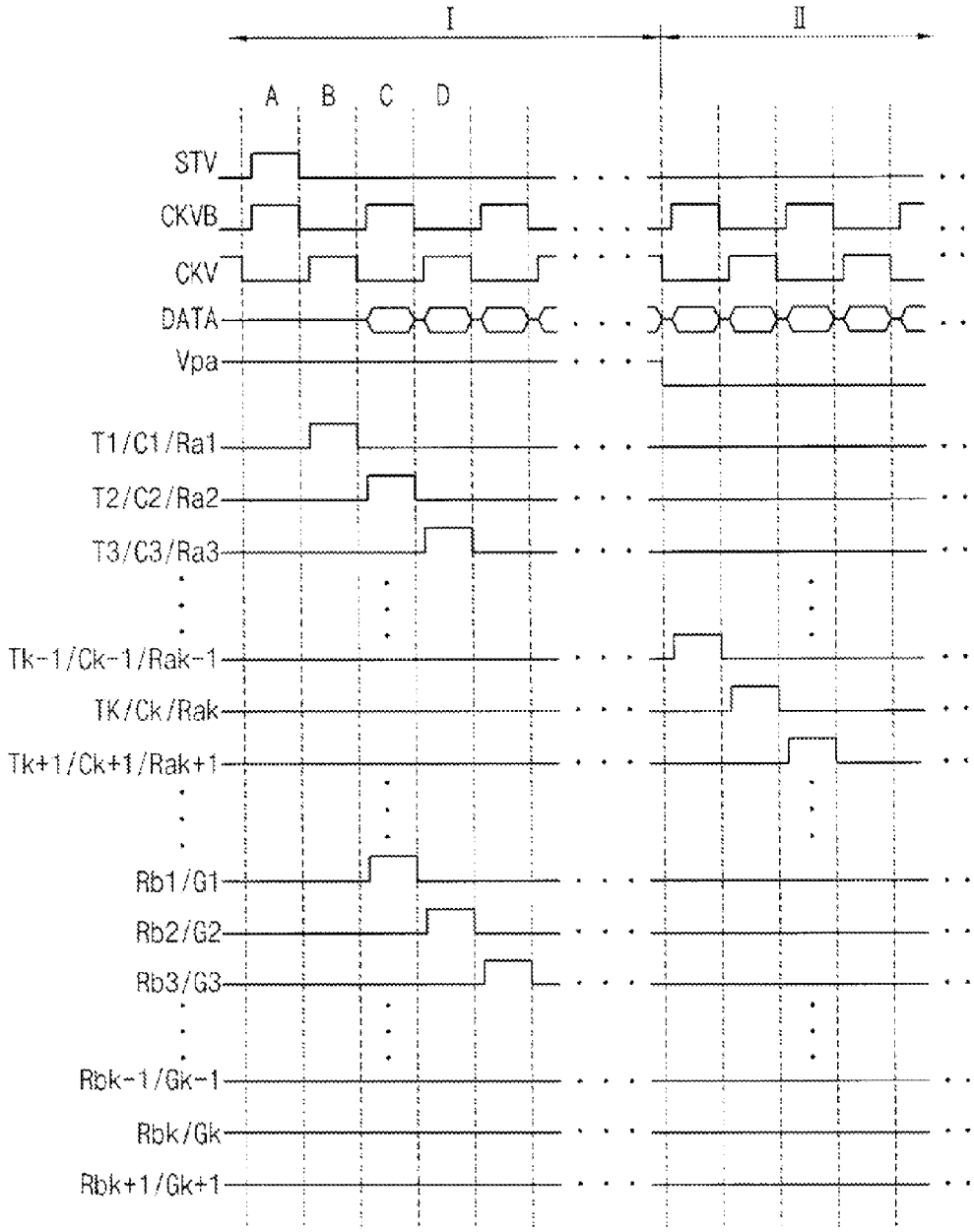
FIG. 4 is a waveform diagram illustrating a signal waveform inputted to the gate driving part shown in FIG. 2.

FIG. 4 is a waveform diagram illustrating signal waveforms inputted to the gate driving part shown in FIG. 2. More specifically, FIG. 4 is a waveform diagram illustrating output waveforms of the signals inputted to the gate driving part 400, and the output waveforms of the delivery, carry, first reset, second reset and gate signals Ti, Ci, Rai, Rbi and Gi as a result of the signals inputted to the gate driving part 400 shown in FIG. 1.

Referring to FIGS. 2 to 4, an operation of the gate driving part 400 according to an exemplary embodiment of the present invention will be explained.

The operation of the gate driving part 400 in a display period I is explained, and then that in a non-display period II will be explained. All nodes of each of the transferring stage SGsi and the output stage SGoi are assumed to be initially in a low voltage state.

The operation of the gate driving part 400 in section A of the display period I is as follows.

The vertical start signal STV having the high level and the clock signal CKV having the low level are respectively inputted to the first input terminal IN1 and the first clock terminal CK1 of the first transferring stage SGs1, and then the tenth TFT T10 is turned on and a high voltage is applied to the third node N3. Accordingly, the eighth TFT T8 is turned on, so that the clock signal CKV having the low level inputted to the first clock terminal CK1 is outputted to the delivery signal TFT T1 through the first output terminal OUT1.

Thus, the second TFT T2 of the first output stage SGo1 maintains a turned-off state. Since voltages having the high level and the low level are applied to both terminals of the third capacitor C3, an electrical charge is discharged, so that the third node N3 bootstraps itself to be the high voltage.

When the reversed clock signal CKVB having the high level is inputted to the second clock terminal CK2 of the first output stage SGo1, the second node N2 electrically connected to the second clock terminal CK2 through the second capacitor C2 becomes in a high state, so that the fourth TFT T4 and the fifth TFT T5 are turned on. Accordingly, the gate off voltage is applied to the first node N1 and the second output terminal OUT2, so that the low level is maintained.

Since the first node N1 is in a low state, the seventh TFT T7 maintains the turned-off state. Since the clock signal inputted to the third clock terminal CK3 is the low level, the sixth TFT T6 also maintains the turned-off state.

In the second transferring stage SGs2, the carry signal C1 having the low level is inputted to the first input terminal IN1, so that the tenth TFT T10 maintains the turned-off state. Accordingly, the eighth TFT T8 also maintains the turned-off state, so that the first output terminal OUT1 maintains the low level. Thus, the second TFT T2 of the second output stage SGo2 maintains the turned-off state.

When the reversed clock signal CKVB having the high level is inputted to the third clock signal CK3 of the second output stage SGo2, the sixth TFT T6 are turned on for the second output terminal OUT2 to maintain the low level. In addition, since the clock signal CKV is inputted to the second clock terminal CK2 of the second output stage SGo2, the second node N2 maintains the low level, so that the fourth TFT T4 and the fifth TFT T5 maintain the turned-off state.

Since, the first output terminal OUT1 of the second transferring stage SGs2 and the second output terminal OUT2 of the second output stage SGo2 maintain the low level, the second input terminal IN2 of the first transferring stage SGs1 electrically connected to the first output terminal OUT1 and the fifth input terminal IN5 of the first output stage SGo1 electrically connected to the second output terminal OUT2 also maintain the low level. Accordingly, the ninth TFT T9 maintains the turned-off state, so that the third node N3 having the high level and the gate off voltage having the low level do not collide with each other. In this case, since the first node N1 of the first output stage SGo1 is the low level, a collision of the voltage does not occur regardless of whether the third TFT T3 is turned on or turned off.

In the third transferring stage SGs3, since the tenth TFT T10 is not turned on by the carry signal C2, the third node N3 maintains the low level. The first output terminal OUT1 maintains the low level in the A section regardless of the clock signal inputted to the first clock terminal.

The even-numbered transferring stages after the fourth transferring stage SGs4 have substantially the same driving conditions as the second transferring stage SGs2 in the A section, and the odd-numbered transferring stages after the fourth transferring stage SGs4 have substantially the same driving conditions as the third transferring stage SGs3 in the A section, so that the first output terminals in all the transferring stages after the fourth transferring stage SGs4 maintain the low level in the A section.

The odd-numbered output stages after the third output stage SGo3 have substantially the same driving conditions as the first output stage SGo1 in the A section, and the even-numbered output stages after the third output stage SGo3 have substantially the same driving conditions as the second output stage SGo1 in the A section, so that the second output terminals OUT2 in all the output stages after the third output stage SGo3 maintain the low level in the A section.

The operation of the gate driving part 400 in a B section of the display period I is as follows.

In the first transferring stage SGs1, since the third node N3 bootstraps itself to be the high voltage, when the clock signal CKV inputted to the first clock terminal CK1 is changed to be the high level, the delivery and carry signals T1 and C1 having the high level are outputted to the first output terminal OUT1.

Thus, the second TFT T2 of the first output pull-up driving control part 440 is turned on, the driving selection signal Vpa having the high level is applied to the first node N1, and the first node becomes in the high voltage state. Accordingly, the first TFT T1 is turned on, so that the reversed clock signal CKVB having the low level is outputted to the second output terminal OUT2. In this case, the high and low voltages are applied to both terminals of the first capacitor C1, and the first node bootstraps itself to be the high voltage. The clock signal CKV having the high level is inputted to the third clock terminal CK3 of the first output stage SGo1, so that the gate off voltage Voff inputted to the power source terminal VSS is outputted to the second output terminal OUT2, and the gate off voltage Voff does not collide with the reversed clock signal CKVB having the low level.

Since the first node N1 is in the high voltage state, the seventh TFT T7 is turned on, so that the second node N2 maintains the low voltage state. Accordingly, the fourth TFT T4 and the fifth TFT T5 maintain the turned-off state.

In the second transferring stage SGs2, the carry signal having the high level outputted from the first output terminal OUT1 of the first transferring stage SGs1 is inputted to the first input terminal IN1, so that the first output terminal OUT1 maintains the low level and the third node N3 bootstraps itself to be the high voltage as the first transferring stage SGs1 in the A section.

The second output stage SGo2 has substantially the same driving conditions as the first output stage SGo1 in section A, so that the second output terminal OUT2 maintains the low level.

The transferring stages after the third transferring stage SGs3 and the output stages after the third output stage SGo3 also have substantially the same driving conditions as mentioned above in section A, so that the first and second output terminals OUT1 and OUT2 maintain the low level.

The operation of the gate driving part 400 in section C of the display period I is as follows.

The second transferring stage SGs2 has substantially the same driving conditions as the first transferring stage SGs1 described in relation to section B, so that the delivery, carry and first reset signals T2, C2 and Ra2 are outputted to the first output terminal OUT1.

Thus, the first reset signal Ra2 having the high level is inputted to the second input terminal IN2 of the first transferring stage SGs1, and the ninth TFT T9 of the first transferring stage SGs1 is turned on, so that the third node N3 of the first transferring stage SGs1 becomes the low voltage stage. Right before the third node N3 is changed to the low voltage due to a duty time of the clock signal CKV, the clock signal CKV inputted to the first clock terminal CK1 is changed to the low level, so that the eighth TFT T8 is turned off to maintain the first output terminal OUT1 to be in the low level after the first output terminal OUT1 is changed from the high level to the low level.

Since the second output stage SGo2 has substantially the same driving conditions as the first output stage SGo1 in section B, the first node N1 bootstraps itself to be the high voltage, and the second output terminal OUT2 maintains the low level. Accordingly, the third TFT T3 of the first output stage SGo1 maintains the turned-off stage.

The first node N1 of the first output stage SGo1 bootstraps itself and the reversed clock signal CKVB having the high level is inputted to the second clock terminal CK2, so that the second output terminal OUT2 of the first output stage SGo1 is changed from the low level to the high level. In this case, since the first node N1 is in the high voltage state, the seventh TFT T7 is in the turned-on state, so that the second node N2 becomes the low voltage state and the fourth TFT T4 and the fifth TFT T5 are not turned on. The clock signal CKV inputted to the third clock terminal CK3 has the low level in section C, so that the sixth TFT T6 is in the turned-off state.

The third transferring stage SGs3 in section C has substantially the same driving conditions as the second transferring stage SGs2 in section B, so that the first output terminal OUT1 maintains the low level and the third node N3 bootstraps itself.

The transferring stages after the fourth transferring stage SGs4 and the output stages after the third output stage SGo3 in section C have substantially the same driving conditions as in sections A and B, so that the first and second output terminals OUT1 and OUT2 maintain the low level.

The operation of the gate driving part 400 in section D of the display period I is as follows.

In the first transferring stage SGs1, before the vertical start signal STV is inputted to the first input terminal IN1, the third node N3 maintains the low voltage stage, so that the eighth TFT T8 maintains the turned-off state. Thus, the first output terminal OUT1 maintains the low level regardless of the state of the clock signal CKV inputted to the first clock terminal CK1.

In the second output stage SGo2, since the first node N1 bootstraps itself, the clock signal CKV having the high level inputted to the second clock terminal CK2 is outputted to the second output terminal OUT2. Thus, the second reset signal Rb2 having the high level is inputted to the fifth input terminal IN5 of the first output stage SGo1, so that the third TFT T3 is turned on and the first node N1 is changed to be in the low voltage state. Since the clock signal CKV inputted to the third clock terminal CK3 of the first output stage SGo1 has the high level the second output terminal OUT2 of the first output stage SGo1 is changed to the low level. The other TFTs are driven as described above.

The other transferring stages and output stages in section D have substantially the same driving conditions as in the previous sections, so that the first and second output terminals OUT1 and OUT2 in section D have the low level.

A driving process of each transferring stage SGsi and each output stage SGoi in the A, B, C and D sections described above, may be equally applicable to the next transferring and output stages. Thus, the first output terminal of the transferring stage SGsi and the second output terminal of the output stage SGoi may sequentially output the high level signal having one vertical period gap.

Then, the operation of the gate driving part 400 in the non-display period II will be explained.

The driving conditions in the non-display period II are basically the same as the driving conditions in the display period I, but the driving area selection signal Vpa inputted to the fourth input terminal IN4 of the output stage SGoi in the non-display period II maintains the low level that is different than in the display period I. Thus, in the non-display period II, since the first node N1 of the output stage SGoi continuously maintains the low voltage state, the gate signal Gi having the high level is not outputted to the second output terminal OUT2 regardless of the sequential driving of the transferring stage SGsi. The transferring stage SGsi, however, is sequentially driven in the non-display period II substantially the same as in the display period I. Thus, when the driving area selection signal Vpa having the high level is inputted to the fourth input terminal IN4 of the output stage SGoi after beginning the display period I again, the screen may be normally displayed.

Figure 5:
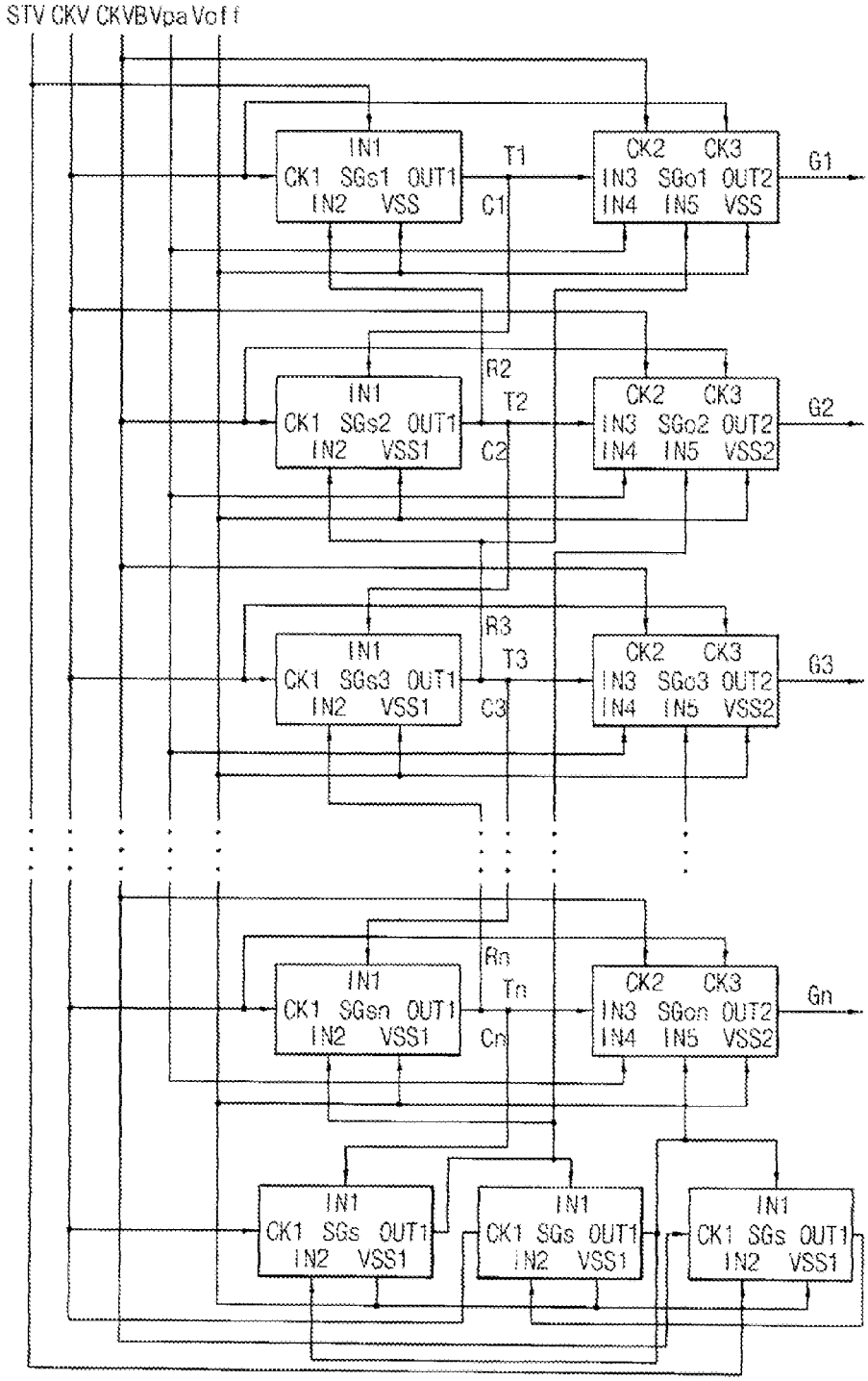
FIG. 5 is a block diagram illustrating a gate driving part according to an exemplary embodiment of the display apparatus in FIG. 1.

FIG. 5 is a block diagram illustrating a gate driving part according to an exemplary embodiment of the display apparatus shown in FIG. 1. The gate driving part shown in FIG. 5 is substantially the same as the exemplary embodiment shown in FIGS. 2 to 4 except in regard to a dummy stage of the gate driving part and the connection of each stage. Thus, the same reference numerals will be used to refer to the same or like parts as those described in the exemplary embodiment of FIGS. 2 to 4 and any further repetitive explanation concerning the above elements will be omitted.

Referring to FIG. 5, the gate driving part includes a driving stage having a plurality of transferring stages SGsi and a plurality of output stages SGoi, a dummy stage having three transferring stages SGsN+1, SGsN+2 and SGsN+3, and a plurality of signal lines STV, CKV, CKVB, Vpa, Voff, Ci, Ti, Ri and Gi inputted or outputted to the driving stage and the dummy stage.

Odd-numbered stages of the driving stage are connected as follows.

In an odd-numbered transferring stage SGs2*k*−1, the first clock terminal CK1 is electrically connected to the clock signal CKV line. The first input terminal IN1 is electrically connected to the first output terminal OUT1 of a previous transferring stage SGs2*k*−2 through a carry signal C2*k*−2 line. The second input terminal IN2 is electrically connected to the first output terminal OUT1 of a next transferring stage SGs2*k* through a reset signal R2*k* line. The first output terminal OUT1 is electrically connected to the second input terminal IN2 of the previous transferring stage SGs2*k*−2, the fifth input terminal IN5 of the previous transferring stage SGo2*k*−3, the first input terminal IN1 of the next transferring stage SGs2*k* and a third input terminal IN3 of a current output stage SGo2*km*, through the reset signal R2*k*−1 line, the carry signal C2*k*−1 line and a delivery signal T2*k*−1 line. The power source terminal VSS is electrically connected to the gate off voltage Voff line.

In an odd-numbered output stage SGo2*k*−1, the second clock terminal CK2 is electrically connected to the reversed clock signal CKVB line. The third clock terminal CK3 is electrically connected to the clock signal CKV line. The third input terminal IN3 is electrically connected to the first output terminal OUT1 of the transferring stage SGs2*k*−1 through the delivery signal T2*k*−1 line. The fourth input terminal IN4 is electrically connected to the driving area selection signal Vpa line. The fifth input terminal IN5 is electrically connected to the first output terminal OUT1 of the next transferring stage SGs2*k*+1 through the reset signal Rb2*k*+1 line. The second output terminal OUT2 is electrically connected to the gate signal G2*k*−1 line. The power source terminal VSS is electrically connected to the gate off voltage Voff line.

In a first transferring stage SGs1 that does not have a previous stage, the first input terminal IN1 is electrically connected to the vertical start signal STV line, and the first output terminal OUT1 is electrically connected to the third input terminal IN3 of the output stage and the first input terminal IN1 of the next transferring stage SGs2.

Even-numbered stages of the driving stage are connected as follows.

In an even-numbered transferring stage SGs2*k*, the first clock terminal CK1 is electrically connected to the reversed clock signal CKVB line. Connections of the first input terminal IN1, the second input terminal IN2, the first output terminal OUT1 and the power source terminal VSS are substantially the same as in the odd-numbered transferring stage SGs2*k*−1.

In an even-numbered output stage SGo2*k*, the second clock terminal CK2 is electrically connected to the clock signal CKV, and the third clock terminal CK3 is electrically connected to the reversed clock signal CKVB. Connections of the third input terminal IN3, the fourth input terminal IN4, the fifth input terminal IN5, the second output terminal OUT2 and the power source terminal VSS are substantially the same as in the odd-numbered output stage SGo2*k*−1.

The first output terminal OUT1 of the second transferring stage SGs2 is electrically connected to the second input terminal IN2 of the previous transferring stage SGs1, the third input terminal IN3 of the output stage SGo2, and the first input terminal IN1 of the next transferring stage SGs3.

The dummy stage is connected as follows.

The dummy stage includes three transferring stages SGsN+1, SGsN+2 and SGsN+3, to reset the driving stage. In the dummy stage, the output of the transferring stage is necessary to reset the driving stage, so that an output stage at the right side of the transferring stage may be eliminated.

Thus, each transferring stage is proposed to be disposed along a horizontal direction as illustrated in FIG. 5, so that an area of the driving part may be reduced.

The connection of the transferring stage of the dummy stage is substantially the same as that of the transferring stage of the driving stage, except that the dummy stage has no output stage. In addition, the connection of the output stage of the dummy stage is substantially the same as that of the output stage of the driving stage. The vertical start signal STV, however, is inputted to the second input terminal IN2 of the final transferring stage SGsN+3 among the transferring stages of the dummy stage.

The dummy stage according to an exemplary embodiment of the present invention includes three transferring stages. Alternatively, the dummy stage may include the same or less than two transferring stages, and may include more than four transferring stages.

In addition, in an exemplary embodiment of the present invention, the vertical start signal STV is inputted to the second input terminal IN2 of the final transferring stage SGsN+3, to reset the driving stage. Alternatively, an additional signal may reset the driving stage, so that resetting the driving stage may be omitted.

As described above, an exemplary embodiment of the present invention may be applicable to the conventional shift registers stage that may be divided into the transferring stage and the output stage.

Figure 6:
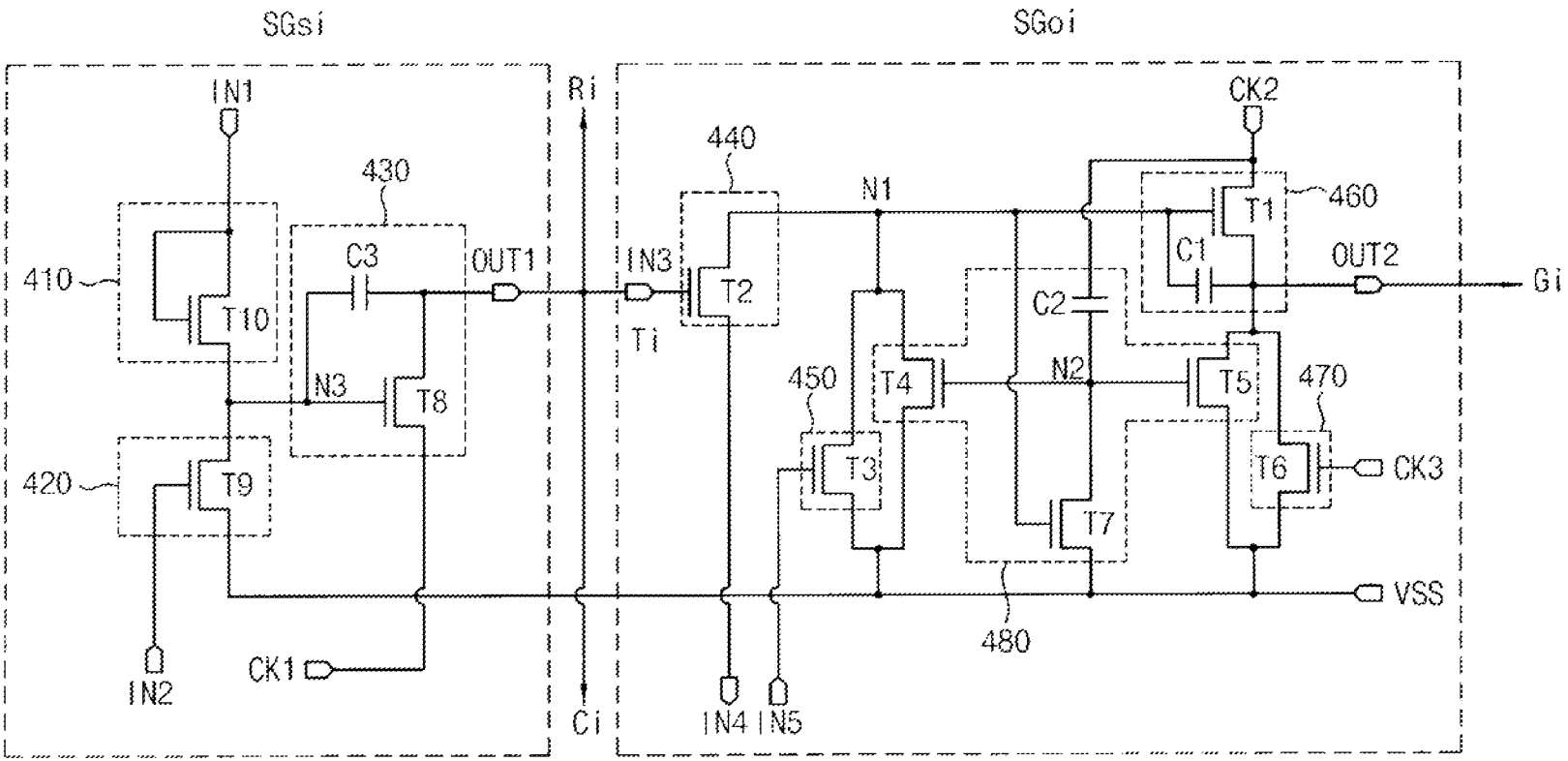
FIG. 6 is a circuit diagram illustrating one of the stages shown in FIG. 5.

FIG. 6 is a circuit diagram illustrating one stage of the gate driving part shown in FIG. 5.

Referring to FIG. 6, the stage includes the transferring stage SGsi and the output stage SGoi.

The transferring stage SGsi is divided into a first transferring pull-up driving control part 410, a second transferring pull-up driving control part 420, and a transferring pull-up driving part 430. The transferring stage SGsi according to the exemplary embodiment of FIG. 6 is substantially the same as in the exemplary embodiment shown in FIG. 3. Thus, the same reference numerals will be used to refer to the same or like parts as those described in the first example embodiment and any further repetitive explanation concerning the above elements will be omitted.

The second transferring pull-up driving control part 420 includes a ninth TFT T9. A drain electrode and a source electrode of the ninth TFT T9 are respectively connected to the third node N3 and the power source terminal VSS, and a gate electrode of the ninth TFT T9 is electrically connected to the second input terminal IN2. The second transferring pull-up driving control part 420 receives a reset signal Ri+1 of the next transferring stage SGsi+1 from the second input terminal IN2, and provides the second control signal having the low level to the control terminal of the transferring pull-up driving part 430.

The output stage SGoi is divided into a first output pull-up driving control part 440, a second output pull-up driving control part 450, an output pull-up driving part 460, an output pull-down driving part 470 and an output maintenance part 480. The output stage SGoi according to this exemplary embodiment is substantially the same as the exemplary embodiment shown in FIG. 3. Thus, the same reference numerals will be used to refer to the same or like parts as those described in the first example embodiment and any further repetitive explanation concerning the above elements will be omitted.

The second output pull-up driving control part 450 includes a third TFT T3. A drain electrode and a source electrode of the third TFT T3 are respectively connected to the first node N1 and the power source terminal VSS, and a gate electrode of the third TFT T3 is electrically connected to the fifth input terminal IN5. The second output pull-up driving control part 450 receives a reset signal Ri+2 of the next transferring stage SGsi+2 from the fifth input terminal IN5, to provide the fourth control signal having a low level to the control terminal of the output pull-up driving part 460.

As described above, an exemplary embodiment of the present invention may be applicable to the conventional shift register stage that may be divided into the transferring stage and the output stage.

The gate driving part 400 according to an exemplary embodiment of the present invention may be formed in a peripheral area of a display substrate when a display cell array circuit is formed. Alternatively, the gate driving part 400 may be combined with the display substrate through an additional integrated circuit. In addition, the gate driving part 400 may be formed by adding a process to the process used in forming the display cell array.

Size, thickness, length and so on of the TFT, the capacitor, the signal line and so on forming the gate driving part, may be safely optimized to operate the gate driving part. An array in the substrate may be optimized to minimize signal delay, interference and so on. For example, the eighth TFT T8 may be designed to be smaller than the first, fifth and sixth TFTs T1, T5 and T6, because the carry signal Ci, the delivery signal Ti and the first reset signal Rai just transfer signals between stages. In addition, one or all of the output pull-down driving part 470 and the output maintenance part 480 may be omitted.

Figure 7:
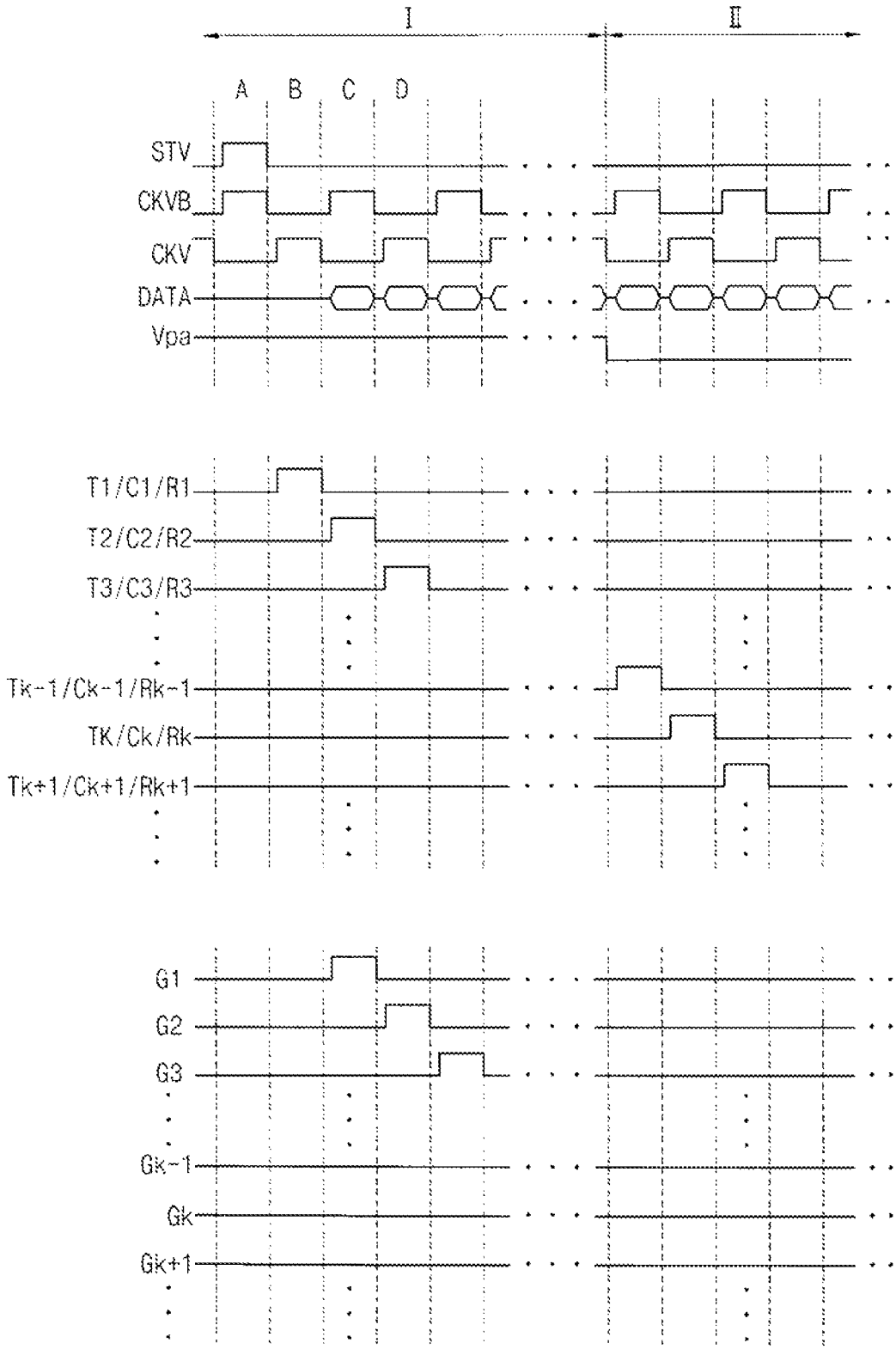
FIG. 7 is a waveform diagram illustrating a signal waveform inputted to the gate driving part in FIG. 5.

FIG. 7 is a waveform diagram illustrating signal waveforms inputted to the gate driving part shown in FIG. 5. More specifically, FIG. 7 is a waveform diagram illustrating output waveforms of the signals inputted to the gate driving part 400, and the output waveforms of the delivery, carry, reset, and gate signals Ti, Ci, Ri, Rbi and Gi as a result of the signals inputted to the gate driving part 400. As illustrated in FIG. 7, the driving area selection signal Vpa maintains a high level in the display period I, and a low level in the non-display period II.

Referring to FIGS. 5 to 7, an operation of the gate driving part 400 according to an exemplary embodiment of the present invention will be explained.

The operation of the gate driving part 400 in the display period I is explained, and then that in the non-display period II will be explained. All nodes of each of the transferring stage SGsi and the output stage SGoi are assumed to be initially in a low voltage state.

The operation of the gate driving part 400 in section A of the display period I is as follows.

The gate driving part 400 according to this exemplary embodiment is driven in substantially the same manner as in the exemplary embodiment shown in FIG. 4 except for driving the first transferring stage SGs1 and the second transferring stage SGs2. Thus, the same reference numerals will be used to refer to the same or like parts as those described above and any further repetitive explanation concerning the above elements will be omitted.

When the vertical start signal STV having the high level and the clock signal CKV having the low level are respectively inputted to the first input terminal IN1 and the first clock terminal CK1 of the transferring stage SGs1, the tenth TFT T10 is turned on and the high voltage is applied to the third node N3. Accordingly, the eighth TFT T8 is turned on, so that the clock signal CKV inputted to the first clock terminal CK1 is outputted to the delivery and carry signal TFT T1 and capacitor C1 through the first output terminal OUT1.

Because the first output terminal OUT1 of the second transferring stage SGs2 maintains the low level, the second input terminal IN2 connected to the first output terminal OUT1 also maintains the low level. Accordingly, the ninth TFT T9 of the first transferring stage SGs1 maintains the turned-off state, so that the third node N3 having the high level and the gate off voltage having the low level, do not collide with each other. Since the first node N1 of the first output stage SGo1 is in the low level, the voltage does not collide regardless of the turned-on or turned-off state of the third TFT T3.

The gate driving part 400 in section B according to the exemplary embodiment is driven in substantially the same manner as in section B of the exemplary embodiment used to produce the waveforms shown in FIG. 4, and thus the same reference numerals will be used to refer to the same or like parts as those described in the first example embodiment and any further repetitive explanation concerning the above elements will be omitted.

The operation of the gate driving part 400 in section C of the display period I is as follows.

The gate driving part 400 is driven in substantially the same manner as in the exemplary embodiment used to produce the waveforms shown in FIG. 4 except driving the second transferring stage SGs2. Thus, the same reference numerals will be used to refer to the same or like parts as those described in the first example embodiment and any further repetitive explanation concerning the above elements will be omitted.

The second transferring stage SGs2 has the same driving conditions as the first transferring stage SGs1 in section B, so that the delivery, carry, reset signals T2, C2 and R2 having the high level is outputted to the first output terminal OUT1.

Thus, the reset signal R2 having the high level is inputted to the second input terminal IN2 of the first transferring stage SGs1, and the ninth TFT T9 of the first transferring stage SGs1 is turned on, so that the third node N3 of the first transferring stage SGs1 becomes in the low voltage state. As illustrated in FIG. 7, the clock signal CKV inputted to the first clock terminal CK1 is changed to be in the low level due to the duty time of the clock signal CKV, and then the third node N3 is changed to be in the low voltage state. Thus, the eighth TFT T8 is turned off to maintain the first output terminal OUT1 to be in the low level, after the first output terminal OUT1 is changed from the high level to the low level.

The operation of the gate driving part 400 in section D of the display period I is as follows.

The gate driving part 400 according to this exemplary embodiment is driven in substantially the same manner as in the above-described exemplary embodiment relative to the waveforms shown in FIG. 4 except driving the second transferring stage SGs2, the third transferring stage SGs3, the first output stage SGo1, and so on. Thus, the same reference numerals will be used to refer to the same or like parts as those described in the first example embodiment and any further repetitive explanation concerning the above elements will be omitted.

The second transferring stage SGs2 has the same driving conditions as the first transferring stage SGs1 in section C, so that the first output terminal OUT1 having the high level is changed to have the low level, and is maintained to have the low level.

The third transferring stage SGs3 has the same driving conditions as the second transferring stage SGs2 in section C, so that the first output terminal OUT1 having the low level is changed to have the high level, and is maintained to have the high level.

In the first output stage SGo1, the reset signal R3 having the high level is inputted from the first output terminal OUT1 of the third transferring stage SGs3 to the fifth input terminal IN5, so that the third TFT T3 is turned on and the first node N1 is changed to be in the low voltage state. Since the clock signal CKV inputted to the third clock terminal CK3 of the first output stage SGo1 has the high level, the second output terminal OUT2 of the first output stage SGo1 is changed to have the low level outputting the gate off voltage Voff inputted to the power source terminal VSS. The other TFTs are driven as described above.

The transferring stages after the fourth transferring stage SGs4 and the output stages after the second output stage SGo2 also have the same driving conditions as described above in the previous sections, so that the second output terminal OUT2 of the second output stage SGo2 in section D maintains the high level, and the first and second output terminals OUT1 and OUT2 of the other stages maintain the low level.

A driving process of each transferring stage SGsi and each output stage SGoi in the A, B, C and D sections described above, may be equally applicable to next transferring and output stages. Thus, the transferring stage SGsi and the output stage SGoi are sequentially turned on along a longitudinal direction and output the high level signals through the first and second output terminals OUT1 and OUT2. The first output terminal of the transferring stage SGsi and the second output terminal of the output stage SGoi sequentially output the high level signal having one vertical period gap.

The gate driving part 400 in the non-display period II according to the exemplary embodiment of the present invention is driven in substantially the same manner as in the exemplary embodiment described in connection with FIG. 4 and, thus, any further repetitive explanation concerning the above elements will be omitted.

The dummy stage is driven and functions as follows.

The dummy stage includes a (n+1)-th transferring stage SGsn+1, a (n+2)-th transferring stage SGsn+2, and a (n+3)-th transferring stage SGn+3, to reset a final driving stage.

The first input terminal OUT1 of the (n+1)-th transferring stage SGsn+1 receives a carry signal Ci from the first output terminal OUT1 of a n-th transferring stage SGsn, and transfers a reset signal Rn+1 to the second input terminal IN2 of the n-th transferring stage SGsn through the first output terminal OUT1 after one vertical period, so that it resets the n-th transferring stage SGsn and transfers a carry signal Cn+1 to the first input terminal of the (n+2)-th transferring stage SGsn+2 at the same time.

The first input terminal IN1 of the (n+2)-th transferring stage SGsn+2 receives the carry signal Cn+1 from the first output terminal OUT1 of a (n+1)-th transferring stage SGsn+1, and transfers a reset signal Rn+2 to the second input terminal IN2 of the (n+1)-th transferring stage SGsn+1 through the first output terminal OUT1 after one vertical period, so that it resets the (n+1)-th transferring stage SGsn+1 and transfers a carry signal Cn+2 to the first input terminal of the (n+3)-th transferring stage SGsn+3 at the same time.

The first input terminal IN1 of the (n+3)-th transferring stage SGsn+3 receives the carry signal Cn+2 from the first output terminal OUT1 of a (n+2)-th transferring stage SGsn+2, and transfers a reset signal Rn+3 to the second input terminal IN2 of the (n+2)-th transferring stage SGsn+2 through the first output terminal OUT1 after one vertical period, so that it resets the (n+2)-th transferring stage SGsn-2. The (n+3)-th transferring stage SGsn+3 resets through the vertical start signal STV.

The driving stage may be reset only through the (n+1)-th transferring stage SGsn+1 and the (n+2)-th transferring stage SGn+2. To drive safely before the next vertical start signal STV is inputted, however, the (n+3)-th transferring stage SGsn+3 must be added to certainly reset the (n+2)-th transferring stage SGsn+2.

When the (n+2)-th transferring stage SGsn+2 is reset by the vertical start signal STV without adding the (n+3)-th transferring stage SGsn+3, the reset signal Rn+2 outputted through the first output terminal OUT1 of the (n+2)-th transferring stage SGsn+2 is fluctuated in a porch period until the vertical start signal is inputted. Accordingly, the third node N3 of the (n+1)-th transferring stage SGsn+1 and the first node N1 of the n-th output stage SGon are fluctuated, so that the n-th gate signal Gn and the gate signal adjacent to the n-th gate signal Gn may be sequentially fluctuated like an exponential function. When more than the (n+4)-th transferring stage is added, the fluctuations may be remarkably decreased.

Figure 8:
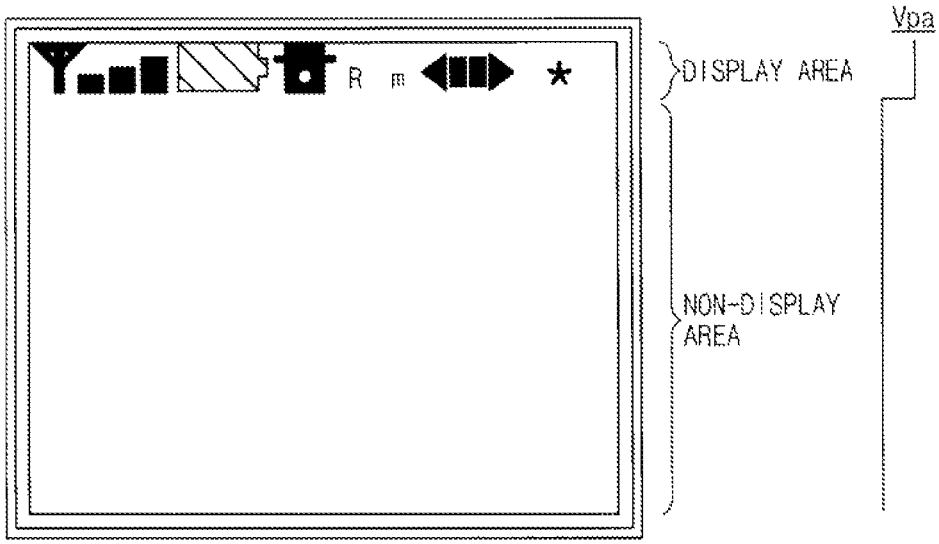
FIG. 8 is a plan view illustrating a screen display state in response to an input signal in an exemplary embodiment of the present invention.
Figure 9:
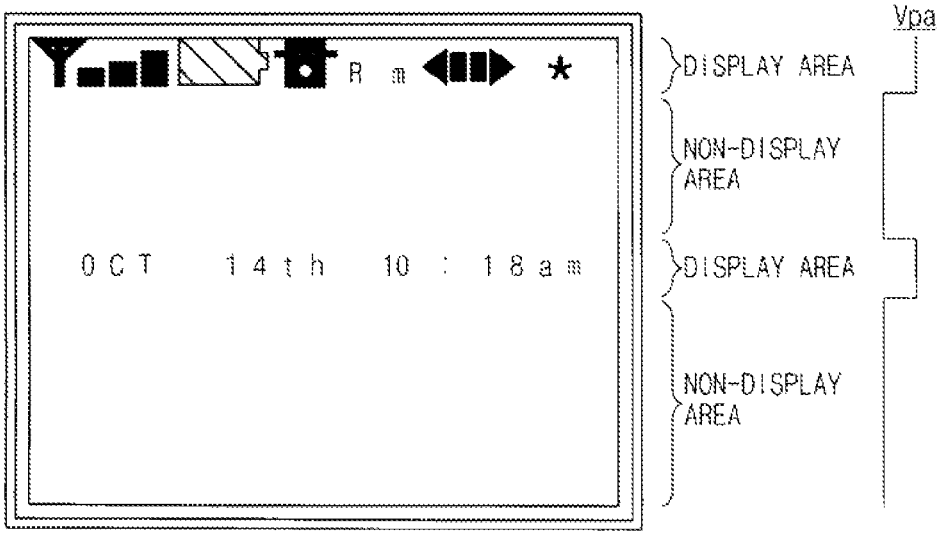
FIG. 9 is a plan view illustrating a screen display state in response to an input signal according to an exemplary embodiment of the present invention.
Figure 10:
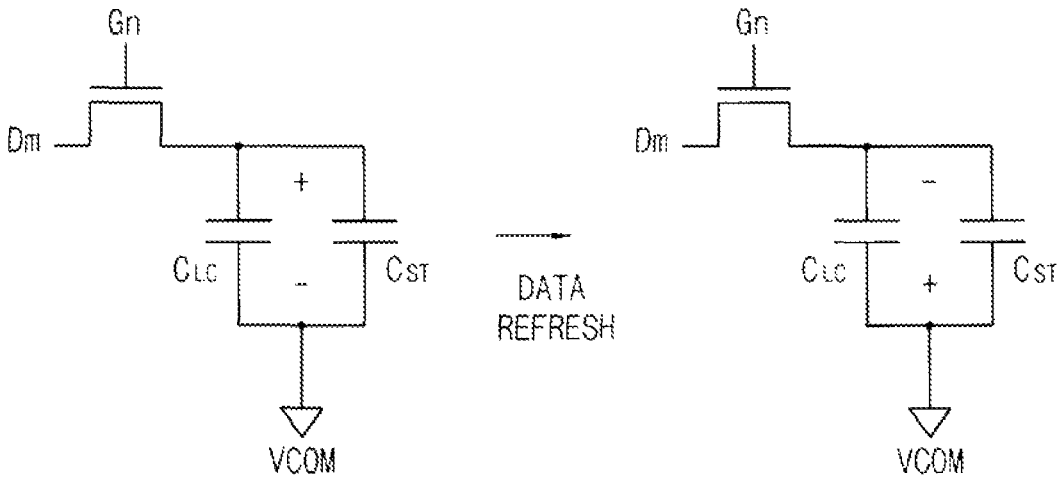
FIG. 10 is a conceptual circuit view illustrating a display information refreshing process.

FIG. 8 is a plan view illustrating a screen display state in response to an input signal applied in accordance with an exemplary embodiment of the present invention. FIG. 9 is a plan view illustrating a screen display state in response to another input signal applied in accordance with an exemplary embodiment of the present invention. FIG. 10 is a conceptual circuit view illustrating a display information refreshing process.

In an exemplary embodiment of the present invention, the display area is disposed at an upper position of the screen and the non-display area is disposed at a lower position of the screen. The driving area selection signal Vpa is changed, however, so that the non-display area may be disposed at an arbitrary position of the screen, and the size and number of the non-display area may be easily controlled.

In the non-display area, a liquid crystal capacitor is maintained to have a predetermined polarity for a long time, so that ions existing in the liquid crystal material may be attached to a predetermined position, thereby to cause afterimages. The afterimages may be a serious problem in the non-display area that displays black in a normally white mode.

Referring to FIG. 10, the attachment of the ions may be caused during a period of several hours, considering a viscosity of the liquid crystal, an intensity of an ion's polarity in the liquid crystal, and a voltage difference between both ends of a liquid crystal cell. Thus, as illustrated in FIG. 10, the afterimages may be easily eliminated by changing the polarity of the voltage held in the liquid crystal cell of the non-display area at intervals of several minutes. In this case, power consumption necessary to change the polarity of the voltage is negligible.

For example, when the liquid crystal display panel is driven by 60 Hz and the voltage in the non-display area is refreshed at intervals of one minute, the power consumption of the non-display area may be 1/3600, which is calculated by dividing 1 by 60 frame rates and 60 seconds, with respect to the power consumption of the display area. Thus, by refreshing the voltage in the non-display area at intervals of several minutes, the afterimages that are caused by changing a partial screen display mode to an overall screen display mode may be solved without increasing the power consumption.

Figure 11:
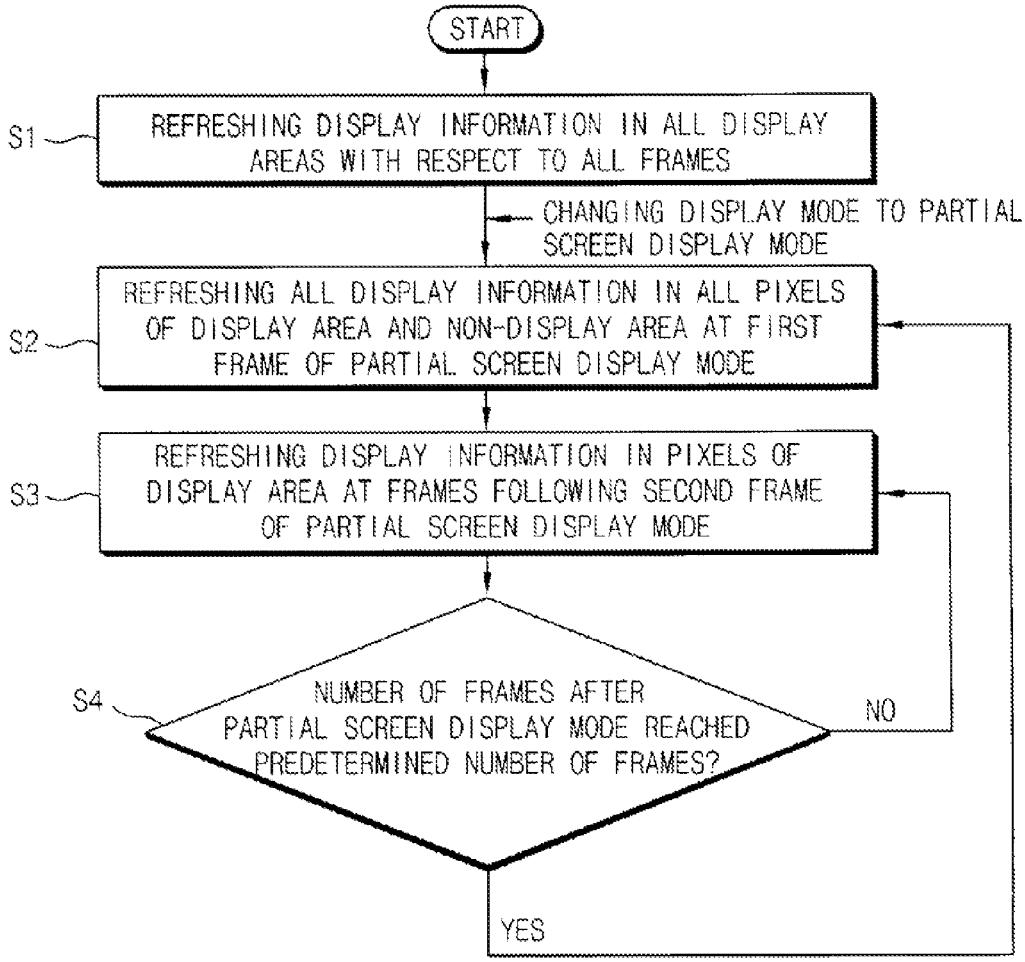
FIG. 11 is a flow chart showing a screen display mode conversion algorithm of the display apparatus according to an exemplary embodiment of the present invention.
Figure 12:
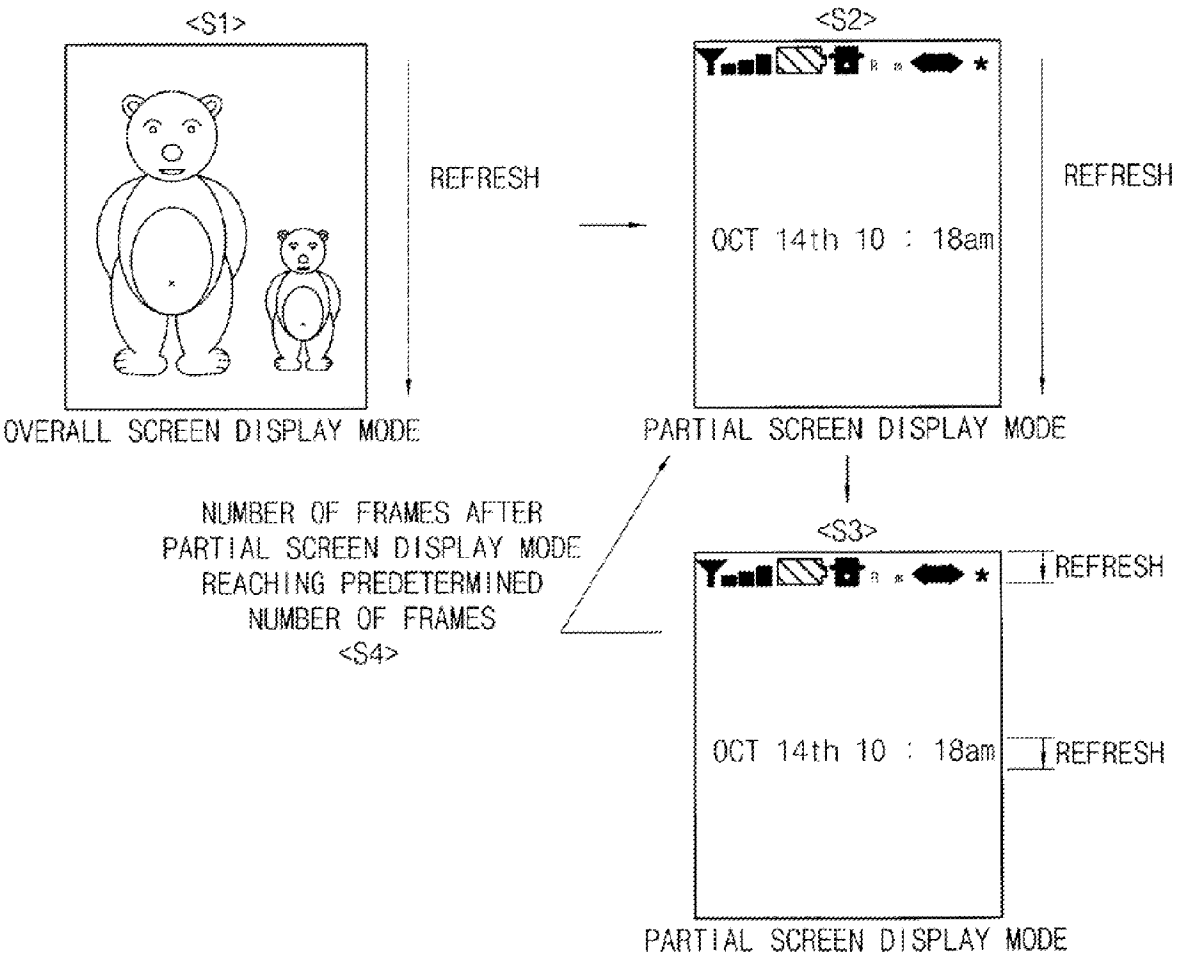
FIG. 12 is a conceptual view illustrating a screen display state corresponding to a screen display mode conversion shown in FIG. 11.

FIG. 11 is a flow chart showing a screen display mode conversion algorithm of the display apparatus according to an exemplary embodiment of the present invention. FIG. 12 is a conceptual view illustrating a screen display state corresponding to a screen display mode conversion in FIG. 11.

Referring to FIGS. 11 and 12, display information is refreshed in all display areas with respect to all frames at an initial overall screen display mode (step S1).

Then, when a display mode is changed to the partial screen display mode, all the display information in all pixels of the display area and the non-display area are refreshed at a first frame of the partial screen display mode (step S2). In this case, the display information in the pixel of the non-display area may be black information.

Then, from a second frame of the partial screen display mode, the display information in the pixels of the display area is refreshed, but the display information in the pixels of the non-display area is maintained to be the display information at the first frame of the partial screen display mode (step S3).

The number of frames after the partial screen display mode is calculated, to reach a predetermined number of frames (step S4). Then, all the display information in the pixels of the display area and the non-display area are refreshed (step S2).

In this case, the refreshed display information in the pixels of the display area has a polarity reversed to that of the display information in the pixels of the previous frame. The refreshed display information in the pixels of the non-display area has the polarity reversed to that of the refreshed display information in the pixels of the previous frame.

According to exemplary embodiments of the present invention, the display apparatus is partially driven, so that current consumption may be decreased.

In addition, the display apparatus may be more safely operated, and a position, a size and the number of the non-display area may be easily controlled.

Having described embodiments of the present invention and their advantages, it is noted that various changes, substitutions and alterations can be made herein without departing from the spirit and scope of the invention as defined by appended claims.

What is claimed is:

1. A display apparatus comprising:

a display panel having a plurality of gate lines; and a gate driving part having a plurality of stages and a plurality of signal lines, the plurality of stages including:

a plurality of transferring stages that sequentially drive the plurality of stages; and a plurality of output stages that sequentially output a gate signal to the gate lines in response to signals outputted from the transferring stages, wherein clock pulses applied to the plurality of stages have substantially the same pulse duration during both the outputting of the gate signal to the at least one of the plurality of gate lines and the skipping of the outputting of the gate signal to a same one of the at least one of the plurality of gate lines, and wherein at least one of the transferring stages applies a carry signal to one of next transferring stages to operate the one of next transferring stages, applies a delivery signal to a current output stage, and applies a first reset signal to one of previous transferring stages, and wherein the current output stage is configured to selectively skip outputting the gate signal to at least one of the gate lines in response to the delivery signal and a driving area selection signal applied thereto.

2. The display apparatus of claim 1, wherein a first period of the driving area selection signal includes a high-level period, and a second period of the driving area selection signal includes a low-level period.

3. The display apparatus of claim 2, wherein at least one of the transferring stages comprises:

a first transferring pull-up driving control part that generates a first control signal;

a second transferring pull-up driving control part that generates a second control signal; and a transferring pull-up driving part that generates an output signal including the carry signal, the delivery signal and the first reset signal in response to the first and second control signals.

4. The display apparatus of claim 2, wherein at least one of the output stages comprises:

a first output pull-up driving control part that generates a third control signal;

a second output pull-up driving control part that generates a fourth control signal; and an output pull-up driving part that generates an output signal in response to the third and fourth control signals.

5. The display apparatus of claim 4, wherein the output signal comprises a gate signal.

6. The display apparatus of claim 5, wherein the output signal further comprises a second reset signal.

7. The display apparatus of claim 6, wherein the first output pull-up driving control part comprises:

a control terminal that receives an output signal of a transferring pull-up signal;

an input terminal that receives the driving area selection signal; and an output terminal that outputs the third control signal.

8. The display apparatus of claim 2, wherein the driving area selection signal has a first phase in an area corresponding to a display period, and has a second phase different from the first phase in an area corresponding to a non-display period.

9. The display apparatus of claim 8, wherein the driving area selection signal has a high level in the area corresponding to the display period, and has a low level in the area corresponding to the non-display period.

10. The display apparatus of claim 2, wherein at least one of the output stages comprises:

a first output pull-up driving control part that generates a third control signal;

a second output pull-up driving control part that generates a fourth control signal; and an output pull-up driving part that generates a gate signal in response to the third and fourth control signal, wherein the driving area selection signal has a high level in an area corresponding to a display period, and has a low level in an area corresponding to a non-display period, and the first output pull-up driving control part includes:

a control terminal that receives an output signal of a transferring pull-up driving part;

an input terminal that receives the driving area selection signal; and an output terminal that outputs a third control signal.

* * * * *